US009884750B2

(12) United States Patent
Maffeis et al.

(10) Patent No.: US 9,884,750 B2
(45) Date of Patent: Feb. 6, 2018

(54) DEVICE FOR REMOTELY COMMANDING A CRANE

(71) Applicant: FASSI GRU S.p.A., Albino (IT)

(72) Inventors: Ivan Maffeis, Stezzano (IT); Roberto Signori, Albino (IT); Giovanni Fassi, Bergamo (IT); Rossano Ceresoli, Ranica (IT)

(73) Assignee: Fassi Gru S.p.A., Albino (IT)

( * ) Notice: Subject to any disclaimer, the term of this patent is extended or adjusted under 35 U.S.C. 154(b) by 0 days.

(21) Appl. No.: 15/409,224

(22) Filed: Jan. 18, 2017

(65) Prior Publication Data

US 2017/0210603 A1 Jul. 27, 2017

(30) Foreign Application Priority Data

Jan. 21, 2016 (IT) ..... 102016000005841

(51) Int. Cl.
*G08B 21/00* (2006.01)
*B66C 13/44* (2006.01)
*G08B 5/22* (2006.01)

(52) U.S. Cl.
CPC ..... *B66C 13/44* (2013.01); *G08B 5/22* (2013.01)

(58) Field of Classification Search
CPC ..... B66C 13/44
USPC ... 340/815.4, 686.1, 685, 679, 691.1, 691.4; 700/83
See application file for complete search history.

(56) References Cited

U.S. PATENT DOCUMENTS

2008/0154395 A1* 6/2008 Henriksson ..... B25J 13/06 700/83

FOREIGN PATENT DOCUMENTS

| | | |
|---|---|---|
| JP | 08-123938 A | 5/1996 |
| JP | 2009-137666 | 6/2009 |
| KR | 2014-0122699 A | 10/2014 |
| WO | WO 2006-036115 A1 | 4/2006 |

OTHER PUBLICATIONS

Ministero Dello Sviluppo Economico, "Search Report for Italian Patent Application Serial No. UB20160254", dated Oct. 14, 2016, Italy (2 Pages).
Ministero Dello Sviluppo Economico, "Search Report for Italian Patent Application Serial No. UB20160254", dated Oct. 14, 2016, Italy (5 Pages).

* cited by examiner

*Primary Examiner* — Jeffery Hofsass
(74) *Attorney, Agent, or Firm* — Mark Malek; Daniel Pierron; Widerman Malek, PL

(57) ABSTRACT

A device for remotely commanding a crane comprises a transmission unit suitable for establishing a communication between the device and a control unit of the crane. The device also includes control panel comprising a plurality of manual control members, each arranged for commanding a specific movement of a plurality of available movements of the crane and the direction of the specific movement. The device may also include a plurality of indicators of the available movements of the crane, each correlated with the specific crane movement commandable by a respective manual control member.

14 Claims, 2 Drawing Sheets

DEVICE FOR REMOTELY COMMANDING A CRANE

FIELD OF THE INVENTION

The present invention refers to a device for remotely commanding a crane, particularly a loading crane.

BACKGROUND

Modern cranes have a plurality of degrees of freedom, particularly a plurality of movements executable for example by its extendable arm or by the components thereof. Such movements are usually commanded by an operator by means of a remote command device, typically a radio command. Such command device comprises a plurality of levers actuatable by the operator, a specific movement and the direction thereof of the crane corresponding to each of them.

The increasing versatility of hydraulic cranes, capable of executing plural movements, causes also an increasing complexity of the command devices which feature several commanding members actuatable by the operator, so that there is a consequent increase of the risk of errors and therefore of failures of the crane, or even injuries to the operator.

Particularly, overload situations of one or more of the parts of a crane, which could cause the crane to flip over or to be damaged, are prevented by automatically switching the crane to a stoppage state in order to prevent the operator to perform some harmful operations, enabling at the same time other operations, particularly the ones necessary to avoid a stoppage situation. For example, if the crane is hoisting a very heavy weight, the extensions of an arm could be extended to a determined length, which cannot be further increased because this would entail risks of breaking or flipping over the crane. In such circumstances, the extensions are prevented from being further lengthened, however it is possible to retract the extensions for preventing an overloading situation.

When there is a stoppage, the operator often has problems in understanding which operations are executable or not. Therefore, visual systems adapted to help the operator execute the correct operations for preventing stoppage conditions, have been proposed.

Particularly, there are radio commands provided with luminous icons, in turn associated to specific movements of a crane, which, by acting on one of the levers, which commands a particular movement, indicate, by a "stop" signal, that the required movement is not available. A similar radio command is described in the international application WO 2006/036115. According to such solution, however the operator must follow a trial-and-error procedure and verify, from time to time, according to his/her experience, if the movement, necessary for overcoming the stoppage situation, is correct or not. Moreover, according to this solution, the operator does not receive any indication regarding the allowable direction and is aware of it, also in this case, only after trials.

Further known devices are provided with a display which shows, always after a specific request of the operator, a schematic image of the overall crane and of all the movable parts thereof, with an indication of all the available and unavailable movements. Such system, even though is complete from a point of view of the information available to the operator, however is difficult to be examined, particularly in case of a crane having several degrees of freedom. Actually, the operator receives by a single display the situation of all the enabled and disabled movements of the crane, and autonomously must understand it and also associate each part of the crane, shown in the display, to a specific command of the radio command. Such operation can require a lot of time. Moreover, the risk of errors for the operator is still high.

SUMMARY OF THE INVENTION

Therefore, an object of the present invention consists of providing a device for remotely commanding a crane, particularly a hydraulic crane, which assists the operator in understanding the available operations, in order to reduce the risk of errors and also the reaction times thereof, which can be crucial under overloading conditions of the crane, for preventing to damage the crane itself, or, at the worst, injuries to the operator commanding it.

This and other objects are obtained by a device for remotely commanding a crane according to claim 1.

BRIEF DESCRIPTION OF THE DRAWINGS

For a better comprehension of the invention and for appreciating the advantages thereof, some exemplifying embodiments thereof will be described in the following with reference to the attached drawings, wherein.

DETAILED DESCRIPTION OF THE INVENTION

Figure 1A:
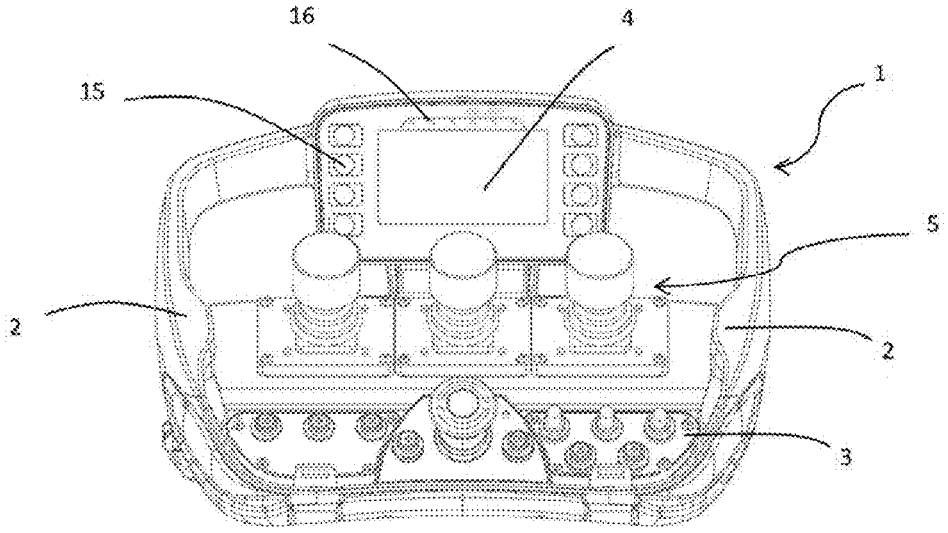
FIGS. 1*a*, 1*b*, 1*c* are lateral views of devices for remotely commanding a crane, according to possible different embodiments of the invention.

Referring to the attached figures, a device for remotely commanding a crane, particularly a hydraulic crane, is generally indicated by reference 1. The device 1 enables an operator to move the movable parts of a crane. For example, the crane available movements can comprise: rotating the column, raising and lowering the first arm, raising and lowering the second arm, extending and retracting the extensions of the second arm, raising and lowering the third arm, extending and retracting the extensions of the third arm, raising and lowering the winch. Obviously, the number and type of movements depend on the type of crane commanded by the device 1.

The crane movements, of which some examples are hereinbelow listed, are provided by respective actuators, usually hydraulic and/or electric ones, associated to respective crane portions. Sensors detect parameters associated to such movements and/or crane portions (for example: elongating the extensions of the arms, bending them, etcetera) and provide signals representative of the same. Such signals are supplied to a crane control unit, which controls the actuators based on signals of the sensors and also based on instructions given to the operator by means of the device 1 itself.

The device 1, in order to communicate with the crane control unit, comprises a dedicated transmission unit which establishes a communication between the device 1 and the crane control unit. Preferably, the device 1 is a radio command, and therefore, the transmission unit is suitable to communicate with the crane control unit by radio signals. Obviously, possible wireless communications of different type are possible, or as an alternative also cable communications, with the crane control unit.

Preferably, the device 1 comprises a battery, still more preferably a rechargeable one, for being capable of using it also without power sources. As an alternative or in addition, the device 1 can be directly connected to an electric power source and supplied by a cable.

Preferably, the device 1 is shaped as a wheel comprising lateral handgrips 2 for enabling the operator to grip it. The device 1 comprises a control panel 3 having, for example, levers and/or buttons for managing the functions of the crane, and preferably, a screen 4 showing the functional information of the crane or of the device 1 itself.

Figure 1B:
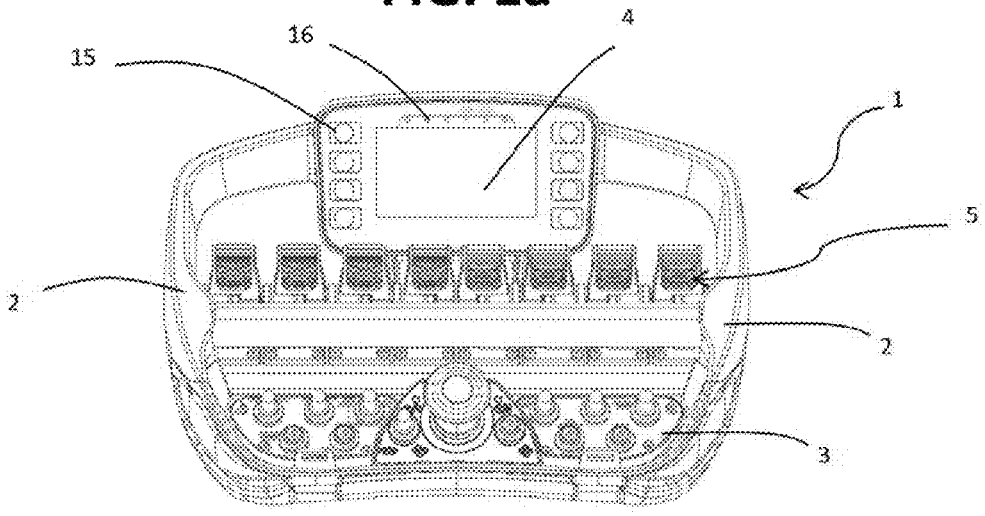
Figure 1C:
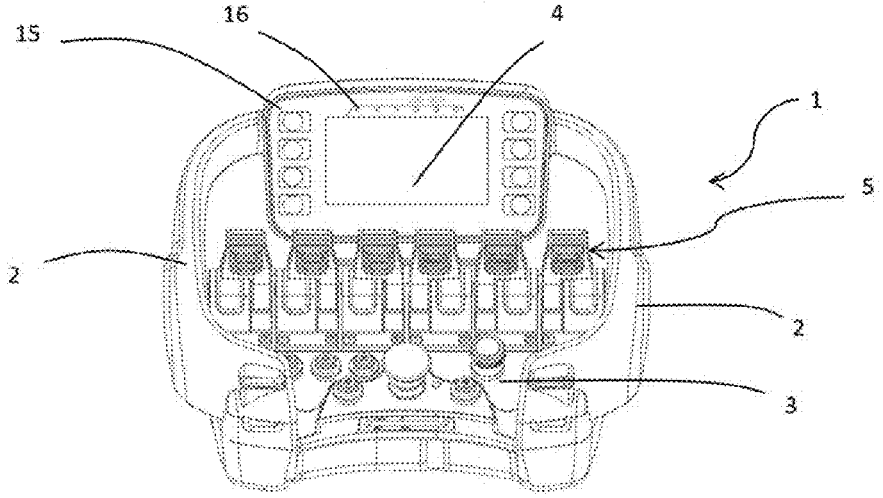

The control panel 3 can comprise, for example, buttons for turning on the device, alarm buttons, acoustic signal emission buttons, buttons for calling up predefined functions, etcetera. Moreover, the control panel 3 comprises a plurality of manual control members 5, each of them managing a specific one of the above cited crane movements and the direction thereof. The manual control members can be, for example, shaped as a joy-stick, according to what is illustrated in FIG. 1*a* or, as forward actuatable levers (for a first movement direction) or backward (for a second movement direction opposite to the first one), according to what is illustrated in FIGS. 1*b* and 1*c*. For example, actuating one of the forward levers makes possible to extract the extensions of the secondary arm, while actuating it backwards makes possible to retract them (or viceversa).

Figure 2:
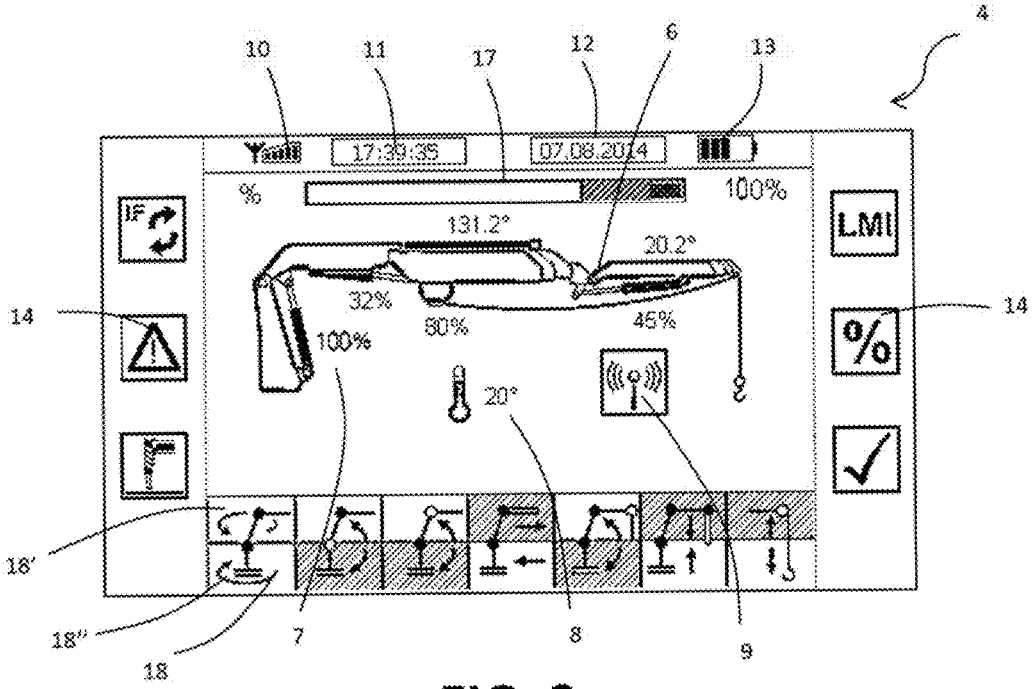
FIG. 2 is a schematic illustration of the icons of a possible display available in the device for remotely controlling a crane, according to a possible embodiment of the invention.

Preferably, the screen 4 is of a touchscreen type, in order to enable the operator to supply instructions by touching the screen 4 itself. FIG. 2 illustrates a possible display supplied by the screen 4. This shows a schematic image of the crane 6 with the commandable and movable parts thereof. Numeral values 7 indicate functional parameters of portions of the crane, such as particularly the load percentage of this portion with respect to the maximum allowed load and numeral absolute values indicating, for example, the linear or angular positions of respective portions of the crane. A bar 17 can visually indicate the total load percentage of the crane, to be intended as the maximum bad percentage allowed among all the bad percentages of the monitored crane portions. Further, an indicator 8 of the oil temperature can be present, which is used for actuating the hydraulic actuators. Further indicators can comprise: an indicator 9 of the presence of a radio communication with the crane control unit, an indicator 10 of the available radio signal level, and indicator 11 of the current time, and indicator 12 of the current date, an indicator 13 of the charge level of the battery. The screen can further provide virtual buttons 14, selectable by a digital action on the touchscreen. Preferably, the virtual buttons 14 are subdivided in groups (with reference to the exemplifying screen in FIG. 2, there are two groups of virtual buttons at the two sides of the screen 4) and, still more preferably, they can be programmed and called up by an user. Moreover, physical buttons 15 and/or analog indicators 16 can be provided adjacent the screen 4, for calling up, for example, predetermined functions or displays. The analog indicators can for example supply an indication similar to the one provided by the bar 17, in other words the level percentage of the total load of the crane, for example when the bar 17 is not displayed in the current screen since a different screen is selected.

Moreover, the device 1 comprises a plurality of indicators 18 of the available movements of the crane. Each of these indicators 18 is associated to a particular movement preferably indicated by a schematic outline illustrating the movement itself, and the directions along which this movement can be performed. Each of these indicators 18 of the available movements corresponds to one of the manual control members 5, which commands the respective movement in the available directions.

Preferably, the indicators 18 and manual control members 5 are disposed with the same order, so that the operator can easily match them.

According to a possible embodiment, the indicators 18 of the available movements are displayed on the screen 4, according to what is illustrated in FIG. 2. Preferably, they are disposed along the bottom side of the screen 4, which is most proximate to the manual control members 5, and therefore logically matching each indicator 18 with each manual control member 5 is simple to the operator.

As an alternative, according to an embodiment not illustrated in the figures, the indicators 18 can comprise luminous indicators distinct from the screen 4.

Each direction of the movement corresponding to the specific indicator of the available movements 18 can be associated to at least two states. For example, exactly two states can be provided: "movement allowed" and "movement inhibited". The state "movement inhibited" corresponds to a stoppage condition of the crane, wherein the movement along to a determined direction is prevented since it would cause a further unallowable overloading on the crane. In addition, a third intermediate state can be provided: "limited movement allowed". Such state corresponds to a condition proximate to the stoppage condition, such that the movement along to a determined direction can be still performed although the stoppage condition is rapidly attained. Such states can be displayed, for example, by lighting with different colours the indicators 18 of the available movements, for example: green corresponds to "movement allowed", red to the "movement inhibited" and yellow to the "limited movement allowed". These states, preferably represented by different colours, are provided for each direction of each movement. Therefore, each movement is provided with two states: one for the first movement direction, and one for the second one.

The states, as displayed by the indicators 18, are determined as a function of signals from the sensors provided in the crane. For example, each quantity has predefined ranges of values and, during the operation, it is determined in which range of predefined values the value detected by the sensors falls. During the operation, following combinations of ranges of values of the magnitudes measured by the sensors will be obtained. Each combination of ranges of values, among all the possible ones, is matched to a respective state for each direction of each movement which will be displayed during the operation by the indicators 18.

Determining the states, according to said modes, is preferably performed by the crane control unit and is transmitted to the remote command device 1, which will make them available to the operator by the indicators 18. For this purpose, a computer program is loaded in a working memory of the crane control unit for determining the states according to said modes.

As an alternative, the device 1 can be provided with an inner control unit capable of determining the states based on signals of sensors, detected by the crane.

The states displayed are updated in real time during the use of the crane. Therefore, the operator will see, instant by instant, changing the colour associated to each direction of each movement, provided by each indicator 18.

With reference to the exemplifying screen shown in FIG. 2, the screen 4 shows seven indicators 18 of the available movements, provided with symbols schematically illustrating the meaning of the same. Obviously, the number and type of such indicators can change according to the type of crane commanded by the device. Each of the indicators 18 comprises a first 18' and second 18" sectors, each of them corresponds to a direction of the movement which the indicator refers to. Each of the sectors 18' and 18", during the operation of the crane, takes a colour different according to the determined state (red, green or yellow, according to what was hereinbefore discussed, for example). FIG. 2 shows, for the sake of comprehension, just two states respectively illustrated with a white background (corresponding to the "movement allowed" state, for example) and with a shaded background (corresponding to the "movement inhibited" state, for example). Each indicator 18, even though is not shown in FIG. 2, will be associated to a specific manual control member 5, actuatable along a first direction (for example, in case of a lever: forward corresponding for example to the direction whose state is indicated by the first section 18' of the respective indicator 18) and along a second direction (for example, in case of a lever: backward, corresponding for example to the direction whose state is indicated by the second sector 18" of the respective indicator 18).

According to the exemplifying screen shown in FIG. 2, therefore, the movements available at the considered instant, are the following: a first movement (shown by the first indicator 18, commendable by the first manual control member 5): first direction (indicated by the first sector 18'), second direction (indicated by the second sector 18");

- a second movement (shown by the second indicator 18, commandable by the second manual control member 5): first direction (indicated by the second sector 18");
- a third movement (shown by the third indicator 18, commandable by the third manual control member 5): first direction (indicated by the second sector 18");
- a fourth movement (shown by the fourth indicator 18, commandable by the fourth manual control member 5): second direction (indicated by the first sector 18');
- a fifth movement (shown by the fifth indicator 18, commandable by the fifth manual control member 5): first direction (indicated by the first sector 18');
- a sixth movement (shown by the sixth indicator 18, commandable by the sixth manual control member 5): second direction (indicated by the first sector 18');
- a seventh movement (shown by the seventh indicator 18, commandable by the seventh manual control member 5): second direction (indicated by the first sector 18').

Therefore, if the operator actuates the allowed movements according to the respective directions by acting on the respective manual control members, the crane will perform such movements. Viceversa, if the operator tries to actuate the inhibited movements according to the respective directions by acting on the respective manual control members, the crane will not perform such movements. Obviously, the indications provided by the indicators 18 will assist the operator in preventing to try to perform inhibited operations.

Figure 3:
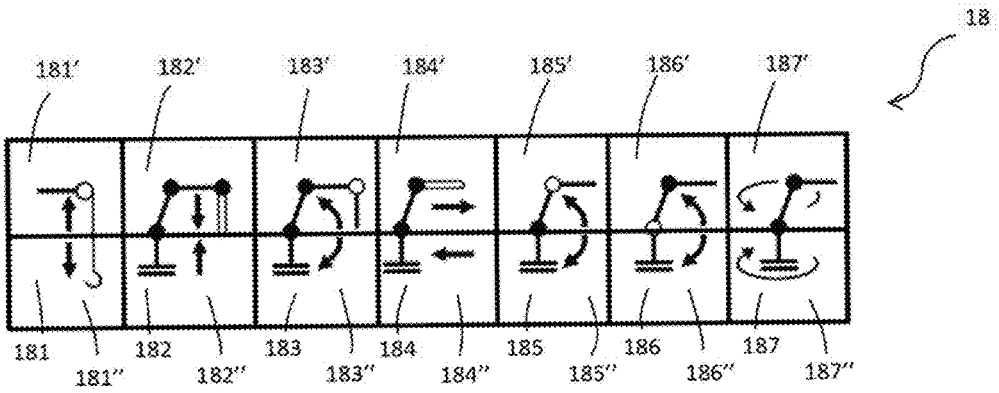
FIG. 3 is a schematic illustration of possible indicators of available movements of the crane, provided in the command device according to a possible embodiment of the invention.

With reference to FIG. 3, possible symbols are now illustrated, which can be associated to each of the indicators 18 for assisting in understanding the movement to which the indicator 18 refers. Particularly, in the shown example:

- the first indicator 181 represents the movement of the crane winch. The first sector 181' represents the winch when raises, while the second sector 181" shows the winch when lowers;
- the second indicator 182 represents the movement of the extensions of the third crane arm. The first sector 182' represents the extensions when they are extracted, while the second sector 182" represents the extensions when they are retracted;
- the third indicator 183 represents the movement of the third crane arm. The first sector 183' represents the third arm when raises, while the second sector 183" represents the third arm when lowers;
- the fourth indicator 184 represents the movement of the extensions of the second crane arm. The first sector 184' represents the extensions of the second arm when they are extracted, while the second sector 184" represents the extensions of the second arm when they are retracted;
- the fifth indicator 185 represents the movement of the second crane arm. The first sector 185' represents the second arm when raises, while the second sector 1835" represents the second arm when lowers;
- the sixth indicator 186 represents the movement of the first crane arm. The first sector 186' represents the first arm when raises, while the second sector 186" represents the first arm when lowers;
- the seventh indicator 187 represents the rotation of the column. The first sector 187' represents the anticlockwise rotation of the column, while the second sector 187" represents the clockwise rotation of the column.

From the above given description, a person skilled in the art will be capable of appreciating as the device for remotely commanding the crane according to the invention, by visually intuitively providing to an operator an indication of the available and inhibited movements of the crane based on the present conditions thereof, substantially reduces the risks of error of the operator and also his/her time or reaction. Therefore, due to the device according to the invention, the risks of crane failures caused by an erroneous use are reduced, and also the risks of injuring the operator commanding the crane.

To the described embodiments of the invention for remotely commanding a crane, the person skilled in the art, in order to satisfy contingent specific needs, could introduce many additions, changes, or substitutions of elements with other operatively equivalent, without however falling out of the scope of the attached claims.

That which is claimed is:

1. A device for remotely commanding a crane, comprising:

- a transmission unit suitable for establishing a communication between the device and a control unit of said crane;
- a control panel comprising a plurality of manual control members, each arranged for commanding a specific movement of a plurality of available movements of the crane and the direction of said specific movement; and
- a plurality of indicators of the available movements of the crane, each correlated with the specific crane movement commandable by a respective manual control member;
- wherein said indicators of the available movements comprise a first sector and a second sector, each corresponding to a direction of the movement associated to the respective indicator, wherein said first and second sectors are configured for providing a visual indication of a state, among at least two states, of the direction of the movement associated to the respective indicator.

2. The device according to claim 1, wherein each of said indicators of the available movements has a schematic illustration of the movement which the same indicator is correlated to.

3. The device according to claim 1, wherein said indicators of the available movements and said manual command members are provided in the device, arranged according to the same sequential order.

4. The device according to claim 1, further comprising a screen suitable for displaying operative information of the crane.

5. The device according to claim 4, wherein said screen is of the touch-screen type and comprises virtual buttons manually actuatable by touching the display itself.

6. The device according to claim 4, wherein said available movements indicators are displayed on said screen.

7. The device according to claim 4, wherein said available movements indicators are distinct and separated from said screen.

8. The device according to claim 1, wherein said at least two states comprise a first state "movement allowed" and a second state "movement inhibited".

9. The device according to claim 8, wherein said at least two states comprise a third state "limited movement allowed".

10. The device according to claim 1, wherein each state is associated to a different color of the respective first and second sector of each indicator of the available crane movements.

11. The device according to claim 1, wherein said transmission unit is configured to establish a communication between the device and the crane control unit using a radio signal.

12. The device according to claim 1, further comprising a battery for supplying the device itself.

13. The device according to claim 1, further comprising an inner control unit configured for determining said state between at least two states based on signals from sensors associated to the crane adapted to sense functional parameters of the crane and/or correlated to said available crane movements.

14. A kit comprising the device for remotely commanding a crane according to claim 1 and a computer program loadable on a working storage of said crane control unit to determine said state between at least two states based on signals from sensors associated to the crane, adapted to sense functional parameters of the crane and/or correlated to said available movements of the crane.

* * * * *